US007070046B2

(12) United States Patent
Cho

(10) Patent No.: US 7,070,046 B2
(45) Date of Patent: Jul. 4, 2006

(54) CAP DEVICE FOR MIXING DIFFERENT KINDS OF MATERIALS SEPARATELY CONTAINED THEREIN AND IN BOTTLE

(76) Inventor: Young Kook Cho, 3090 E. 50th St., Vernon, CA (US) 90052

( * ) Notice: Subject to any disclaimer, the term of this patent is extended or adjusted under 35 U.S.C. 154(b) by 250 days.

(21) Appl. No.: 10/453,729

(22) Filed: Jun. 3, 2003

(65) Prior Publication Data

US 2003/0222102 A1 Dec. 4, 2003

(51) Int. Cl.
*B65D 25/08* (2006.01)

(52) U.S. Cl. ..... 206/221; 206/219; 215/DIG. 8

(58) Field of Classification Search ..... 206/219, 206/222, 221; 215/DIG. 8; 222/80, 91; 220/278; 83/660
See application file for complete search history.

(56) References Cited

U.S. PATENT DOCUMENTS 6,705,462 B1 * 3/2004 Kasuya ..... 206/222
6,763,939 B1 * 7/2004 Alticosalian ..... 206/222
2003/0213709 A1 * 11/2003 Gibler et al. ..... 206/219
2004/0007481 A1 * 1/2004 Kiser, Jr. ..... 206/219
2004/0200740 A1 * 10/2004 Cho ..... 206/219
2004/0200741 A1 * 10/2004 Cho ..... 206/219
2004/0200742 A1 * 10/2004 Cho ..... 206/219

* cited by examiner

*Primary Examiner*—David T. Fidei
(74) *Attorney, Agent, or Firm*—Jerry H. Noh

(57) ABSTRACT

A cap device for bottles, which is capable of mixing an additive contained therein with a material contained in a bottle to prepare a mixture in accordance with a simple rotating action of the cap device relative to the bottle, performed by a user, thus allowing the user to easily prepare the mixture just before taking or using the mixture. The cap device has a cap body tightened to an externally threaded mouth of the bottle, with a funnel part integrally formed in the cap body to discharge the additive from the cap body into the bottle through a lower end thereof. A cap cover is assembled with the cap body to cover an open upper end of the cap body while defining a cavity inside both the cap body and the cap cover to contain the additive in the cavity. The cap device also has a valve means for opening or closing the lower end of the funnel part of the cap body in accordance with the rotating action of the cap body relative to the externally threaded mouth of the bottle.

1 Claim, 9 Drawing Sheets

CAP DEVICE FOR MIXING DIFFERENT KINDS OF MATERIALS SEPARATELY CONTAINED THEREIN AND IN BOTTLE

BACKGROUND OF THE INVENTION

1. Field of the Invention

The present invention relates, in general, to caps for bottles which contain a variety of materials, such as drinks, liquid medicines or liquid chemicals, therein and, more particularly, to a cap device for such bottles, which is capable of mixing an additive contained therein with a material contained in a bottle to prepare a mixture in accordance with a simple rotating action of the cap device relative to the bottle, performed by a user, thus allowing the user to easily prepare the mixture just before taking or using the mixture.

2. Description of the Related Art

In the prior art most of conventional disposable bottles circulated and sold in markets each contain therein only a single kind of material, such as a drink, a liquid medicine or a liquid chemical, and are closed by caps at mouths thereof. When a user wants to add an additive to the material contained in such a capped bottle so as to prepare a mixture prior to taking or using the mixture, the user must add the additive from a separate container to the bottled material after removing a cap from the bottle. Therefore, it is necessary for manufacturers of the additives and the bottled materials to separately contain such additives and materials in separate containers and bottles prior to marketing them, thus undesirably wasting natural resources due to the production of the separate containers and capped bottles. In addition, the adding of the additive from the separate container to the bottled material to mix them after removing the cap from the bottle is inconvenient to the user, because the user is forced to separately purchase and handle the additive container and the bottle.

Furthermore, it is almost impossible for the user to add a precise desired amount of the additive from the separate container to the material contained in the bottle. In such a case, the user ends up roughly measuring the amount of the additive to be added to the bottled material. Therefore, in the case of mixing of an additive with a bottled drink to produce a mixed beverage, the rough measurement of the amount of the additive may result in change in taste and quality of the mixed beverage. In the case of mixing of an additive with a bottled liquid medicine or a bottled liquid chemical to produce a mixed medicine or a mixed chemical, the rough measurement of the amount of the additive may result in incomplete dissolution of effective ingredients of the additive in the medicine or the chemical and a failure of accomplishment of desired medical or chemical effects of the mixed medicine or the mixed chemical.

Of course, when mixtures are prepared by manufacturers at factories and are marketed in a bottled state, in place of allowing users to mix additives with bottled materials to prepare mixtures just before taking or using the mixtures, it is possible to avoid the above-described problems experienced in the mixing of the additives with the bottled materials performed by the users. However, the mixtures which are prepared by the manufacturers and marketed in the bottled state are problematic in that the effects of ingredients of the bottled mixtures may be gradually degraded as time goes by, in addition to change in colors of the mixtures. Furthermore, the bottled mixtures may generate floating matters and deposit therein with passage of time.

SUMMARY OF THE INVENTION

Accordingly, the present invention has been made keeping in mind the above problems occurring in the prior art, and an object of the present invention is to provide a cap device for bottles, which is capable of mixing an additive contained therein with a bottled material to prepare a mixture in accordance with a simple rotating action of the cap device relative to a bottle, performed by a user, thereby allowing the user to easily prepare the mixture just before taking or using the mixture, and overcoming the problems of degradation in the effects of ingredients, change in colors, and the generation of floating matters and deposit experienced in conventional bottled mixtures marketed in a bottled state, and which allows the user to mix a precise amount of the additive with the bottled material to prepare the mixture, thus preventing change in taste and quality of the mixture in the case of preparing a mixed beverage through the mixing, and preventing incomplete dissolution of effective ingredients of the additive in the bottled material or a failure of accomplishment of desired medical or chemical effects of the mixture in the case of preparing a mixed medicine or a mixed chemical through the mixing, and which allows the user to be free from inconvenience caused by separate purchasing and handling of a conventional additive container and bottle.

In order to accomplish the above objects, the present invention provides a cap device for bottles, comprising: a cap body tightened to an externally threaded mouth of a bottle, with a funnel part integrally formed in the cap body to discharge an additive from the cap body into the bottle through a lower end thereof; a cap cover assembled with the cap body to cover an open upper end of the cap body while defining a cavity inside both the cap body and the cap cover to contain the additive in the cavity; and a valve means for opening or closing the lower end of the funnel part of the cap body in accordance with a rotating action of the cap body relative to the externally threaded mouth of the bottle.

In an embodiment of the present invention, the valve means comprises: a gate unit having a cylindrical part engaging upward over the lower end of the funnel part of the cap body through a screw-type engagement, with a plurality of additive discharging holes formed around a lower portion of a sidewall of the cylindrical part and a plurality of radial ribs extending outward from the lower portion of an external surface of the sidewall of the cylindrical part in radial directions such that outside ends of the radial ribs are supported on an inner surface of a neck of the bottle; an elastic member received in the cylindrical part of the gate unit; and a valve member received in the cylindrical part of the gate unit at a position between the lower end of the funnel part and the elastic member such that the valve member is elastically biased upward by the elastic member, thus opening or closing the additive discharging holes of the cylindrical part of the gate unit in accordance with the rotating action of the cap body relative to the externally threaded mouth of the bottle.

In another embodiment of the present invention, the valve means comprises: a valve member having a valve part to be brought into close contact with or spaced apart from the lower end of the funnel part of the cap body, which acts as a valve seat, thus closing or opening the lower end of the funnel part in accordance with the rotating action of the cap body relative to the externally threaded mouth of the bottle, with a plurality of radial ribs extending outward from an external surface of the valve part in radial directions such that outside ends of the radial ribs are supported on the inner surface of the neck of the bottle.

In a further embodiment of the present invention, the valve means comprises: an arc-shaped projection externally formed on a sidewall of the lower end of the funnel part of the cap body at a predetermined portion such that the arc-shaped projection has a predetermined length and a radius of curvature larger than a radius of rotation of the cap body, with the lower end of the funnel part being closed, and the arc-shaped projection being open; a breakable sheet attached to the arc-shaped projection to close the open projection; and a cutting blade projected from the inner surface of the neck of the bottle at a position corresponding to the breakable sheet to break the breakable sheet in accordance with the rotating action of the cap body relative to the externally threaded mouth of the bottle.

In still another embodiment of the present invention, the valve means comprises: a breakable sheet attached to the lower end of the funnel part of the cap body to close the lower end of the funnel part, and having a structure to be easily broken to open the lower end of the funnel part when the sheet is thrust in a horizontal direction; a breaking ring provided at a predetermined position on an outside area of a lower surface of the breakable sheet; and a thrusting rod projected from the inner surface of the neck of the bottle at a position corresponding to the breaking ring when the breaking ring is rotated to move up along with the cap body, thus coming into contact with the breaking ring to thrust the ring in the horizontal direction.

In the above cap device, the breaking ring has a structure to be thrust circumferentially on the breakable sheet. A protrusion is provided on the breakable sheet at a position around the ring to allow the ring to support the ring. The ring is thus always kept upright even when it is thrust horizontally to break the breakable sheet.

In addition, the breakable sheet attached to the lower end of the funnel part has a breaking line which has a sine-curved line part and an edge line part, and along which the sheet is broken to form a large opening at the lower end of the funnel part when the breakable sheet is thrust to be broken.

In yet another of the present invention, the cap device further comprises: an externally threaded spout formed at a bottom of the bottle; a mixture dispensing means removably engaging with the externally threaded spout of the bottle; and a cup member removably fitted over a lower portion of a sidewall of the bottle to cover the mixture dispensing means.

In the present invention, the mixture dispensing means may comprise a mixture-dispensing piece having internal threads to engage with the externally threaded spout of the bottle.

Alternatively, the mixture dispensing means may comprise a mixture spray unit having internal threads to engage with the externally threaded spout of the bottle.

In the present invention, the cap body and the cap cover of the cap device may be assembled into a single body by use of a threaded structure and a toothed structure.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
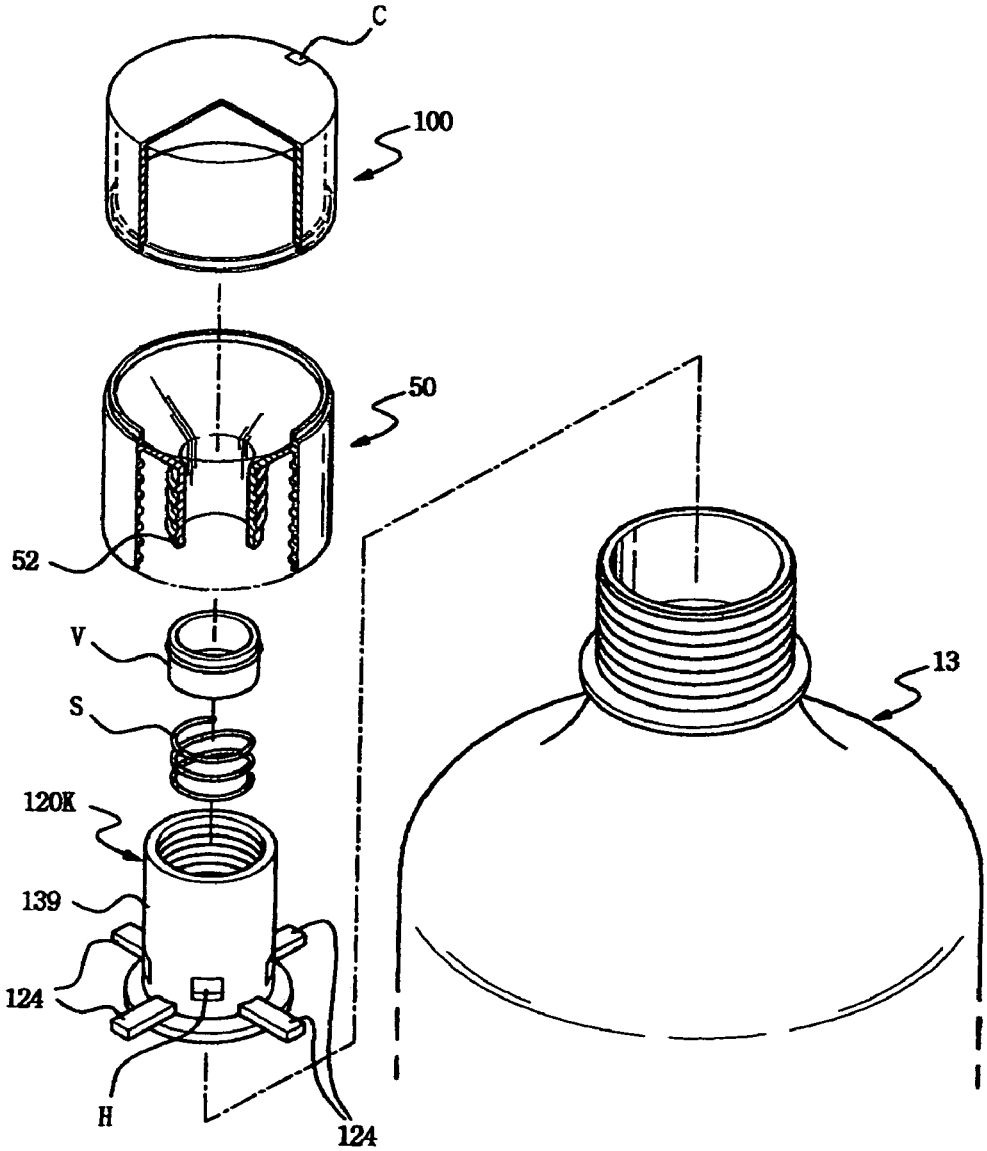
FIG. 1 is an exploded and partially broken perspective view showing a construction of a cap device, according to a first embodiment of the present invention.

Reference should now be made to the drawings, in which the same reference numerals are used throughout the different drawings to designate the same or similar components.

Figure 2:
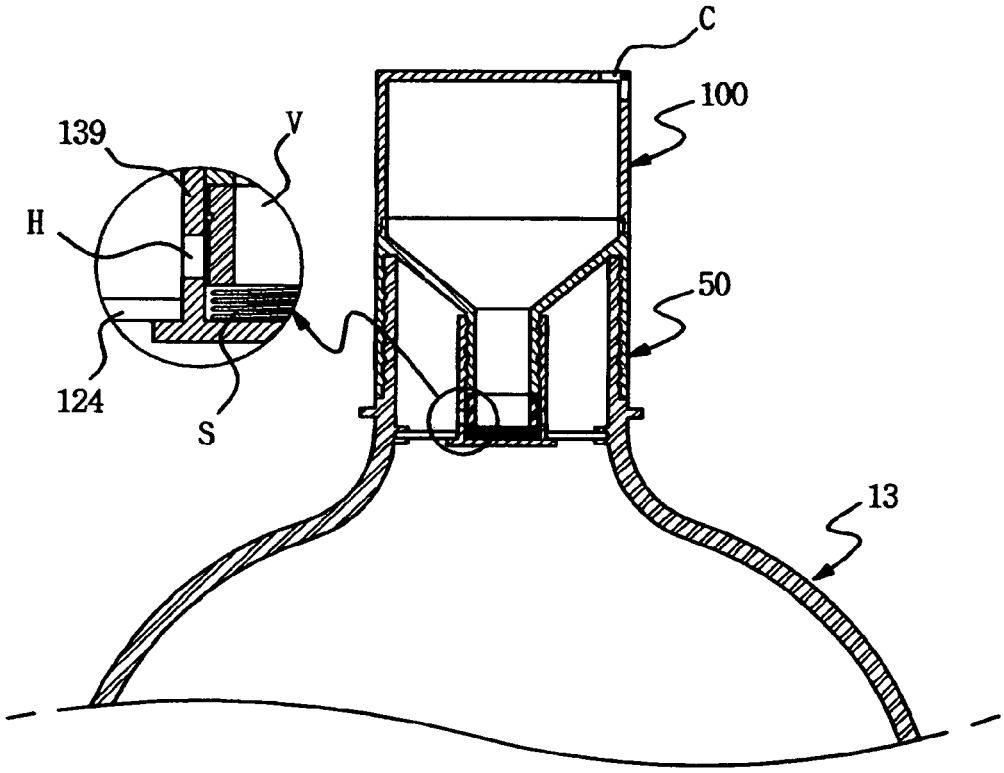
FIG. 2 is a sectional view of the cap device of FIG. 1, when the assembled cap device is tightened to a mouth of a bottle.

FIGS. 1 and 2 are views of a cap device for bottles according to a first embodiment of the present invention. As shown in the drawings, the cap device according to the present invention comprises a cap body 50, and a cap cover 100 assembled with the cap body 50 to define a cavity therein to contain an additive in the cavity. The cap device also has a valve means to allow the cavity defined by the cap body 50 and the cap cover 100 to selectively communicate with an interior of a bottle 13.

In a detailed description, the cap body 50 is tightened to an externally threaded mouth of the bottle 13, with a funnel part 52 integrally formed in the cap body 50 to discharge the additive into the bottle 13 through a lower end thereof.

The cap cover 100 is assembled with the cap body 50 to cover an open upper end of the cap body 50 while defining the cavity inside both the cap body 50 and the cap cover 100 to contain the additive in the cavity.

In the first embodiment, the valve means has a plurality of additive discharging holes "H", and is installed in a neck of the bottle at a predetermined position while being assembled with the lower end of the funnel part 52 through a screw-type engagement to open or close the additive discharging holes "H" in accordance with a rotating action of the cap body 50 relative to the externally threaded mouth of the bottle 13.

That is, the valve means according to the first embodiment comprises a gate unit 120K having both a cylindrical part 139 and a plurality of radial ribs 124, an elastic member "S", and a valve member "V". The cylindrical part 139 of the gate member 120K engages upward over the lower end of the funnel part 52 of the cap body 50 through the screw-type engagement, with the additive discharging holes "H" formed around a lower portion of a sidewall of the cylindrical part 139. The plurality of radial ribs 124 extend outward from the lower portion of an external surface of the sidewall of the cylindrical part 139 in radial directions such that outside ends of the radial ribs 124 are supported on the inner surface of the neck of the bottle 13.

The elastic member "S" is received in the cylindrical part 139 of the gate unit 120K to elastically support the funnel part 52 of the cap body 50. The valve member "V" is received in the cylindrical part 139 of the gate unit 120K at a position between the lower end of the funnel part 52 and the elastic member "S" such that the valve member "V" is elastically biased upward by the elastic member "S". The valve member "V" thus opens or closes the additive discharging holes "H" of the cylindrical part 139 of the gate unit 120K in accordance with a rotating action of the cap body 50 relative to the externally threaded mouth of the bottle 13.

In the first embodiment, the cap body 50 which is tightened to the externally threaded mouth of the bottle 13, and the cylindrical part 139 of the gate member 120K which engages over the lower end of the funnel part 52 of the cap body 50 through the screw-type engagement have the same pitch of threads. The cap body 50 is thus smoothly moved upward or downward in accordance with a rotating action thereof relative to the externally threaded mouth of the bottle 13.

Figure 3:
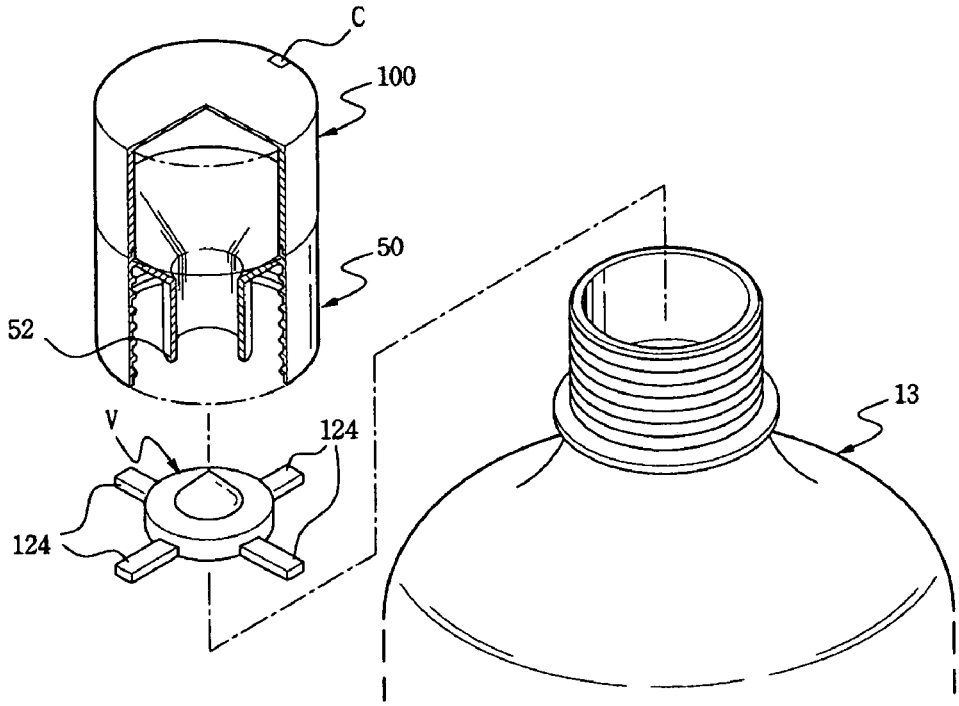
FIG. 3 is an exploded and partially broken perspective view showing a construction of a cap device, according to a second embodiment of the present invention.
Figure 4:
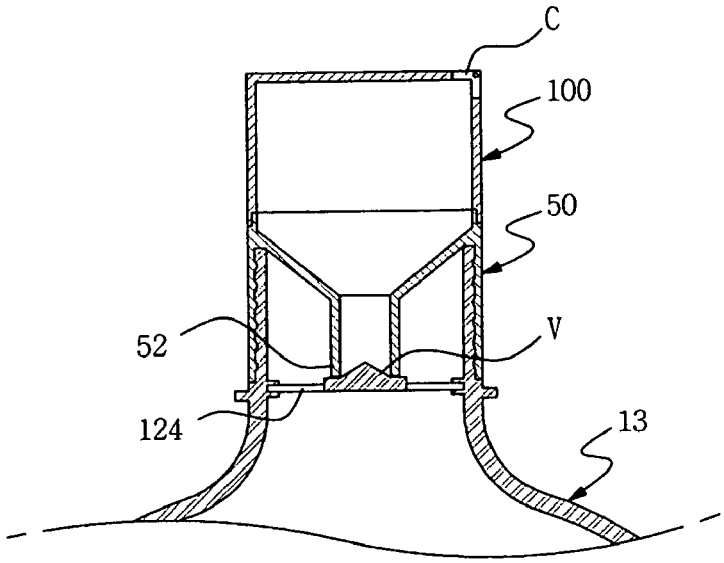
FIG. 4 is a sectional view of the cap device of FIG. 3, when the assembled cap device is tightened to a mouth of a bottle.

FIGS. 3 and 4 are views of a cap device for bottles according to a second embodiment of the present invention. As shown in the drawings, the general shape of the cap device according to the second embodiment remains the same as that described for the first embodiment, but the valve means is altered as follows. That is, the valve means according to the second embodiment comprises a valve member "V" having a valve part to be brought into close contact with or spaced apart from the lower end of the funnel part 52 of the cap body 50, which acts as a valve seat. The valve part of the valve member "V" thus closes or opens the lower end of the funnel part 52 in accordance with the rotating action of the cap body 50 relative to the externally threaded mouth of the bottle 13, with a plurality of radial ribs 124 extending outward from an external surface of the valve part in radial directions such that outside ends of the radial ribs 124 are supported on the inner surface of the neck of the bottle 13.

Figure 6:
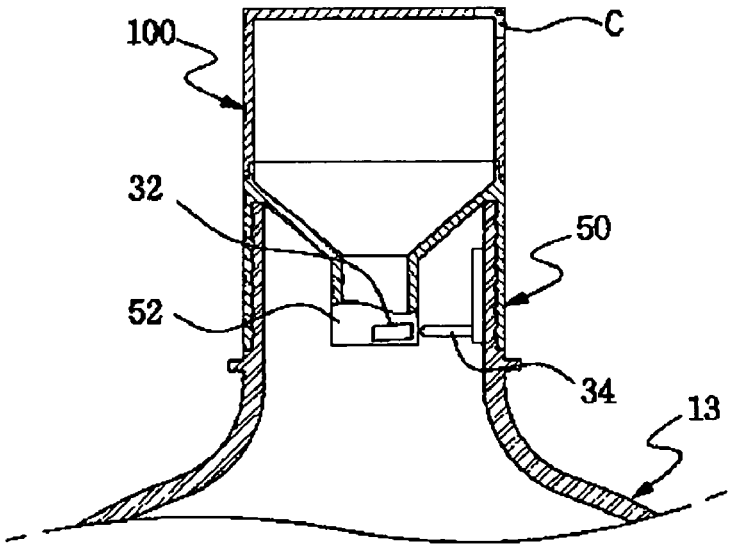
FIG. 6 is a sectional view of the cap device of FIG. 5, when the assembled cap device is tightened to a mouth of a bottle.
Figure 5:
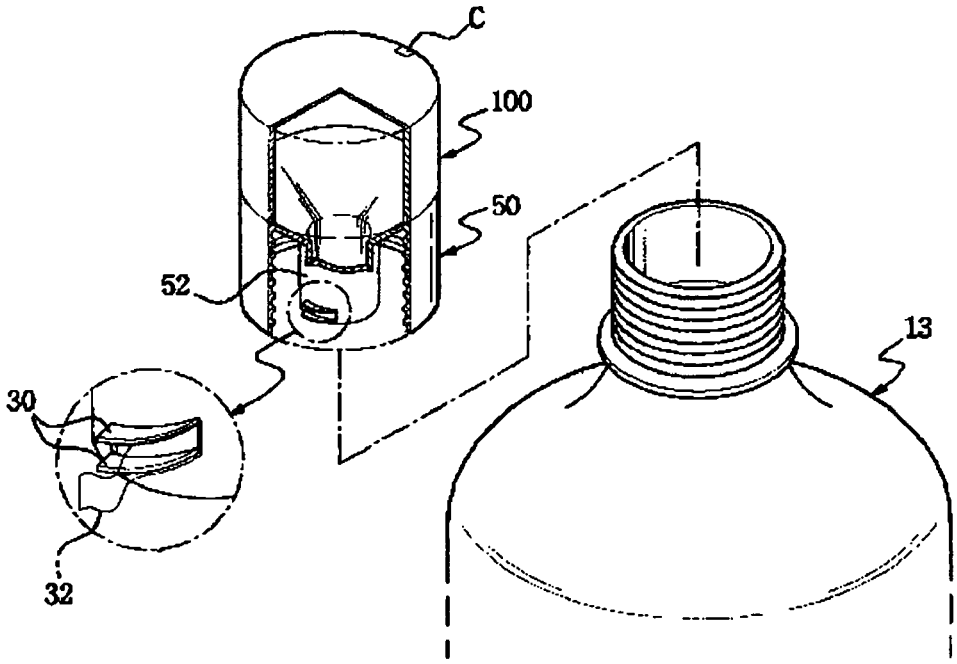
FIG. 5 is an exploded and partially broken perspective view showing a construction of a cap device, according to a third embodiment of the present invention.

FIGS. 5 and 6 are views of a cap device for bottles according to a third embodiment of the present invention. As shown in the drawings, the general shape of the cap device according to the third embodiment remains the same as that described for the first embodiment, but the valve means is altered as follows. That is, the valve means according to the third embodiment comprises an arc-shaped projection 30 externally formed on a sidewall of the lower end of the funnel part 52 of the cap body 50 at a predetermined portion such that the arc-shaped projection 30 has a predetermined length and a radius of curvature larger than a radius of rotation of the cap body 50.

In the third embodiment, the lower end of the funnel part 52 is closed, while the arc-shaped projection 30 is open. A breakable sheet 32 is attached to the arc-shaped projection 30 to close the open projection 30.

A cutting blade 34 is projected from the inner surface of the neck of the bottle 13 at a position corresponding to the breakable sheet 32 to break the breakable sheet 32 in accordance with the rotating action of the cap body 50 relative to the externally threaded mouth of the bottle 13.

When the cap body 50 of the cap device having the above-described construction is rotated to move up relative to the externally threaded mouth of the bottle 13, the valve means opens the lower end of the funnel part 52 of the cap body 50. Therefore, the cavity defined by the cap body 50 and the cap cover 100 of the cap device communicates with the interior of the bottle 13. The additive is thus discharged from the cavity defined by the cap body 50 and the cap cover 100 into the bottle 13 to be mixed with a material contained in the bottle 13 to produce a mixture.

The arc-shaped projection 30 has an angle of inclination corresponding to a pitch of the internal threads of the cap body 50 which is tightened to the externally threaded mouth of the bottle 13. Therefore, when the cap body 50 of the cap device is rotated to move up relative to the externally threaded mouth of the bottle 13, the cutting blade 34 provided at the inner surface of the neck of the bottle 13 reliably breaks the breakable sheet 32 of the cap body 50 and opens the lower end of the funnel part 52 of the cap body 50. The cavity of the cap device thus communicates with the interior of the bottle 13 through the open lower end of the funnel part 52, so that the additive smoothly flows from the cavity into the bottle 13.

Figure 7:
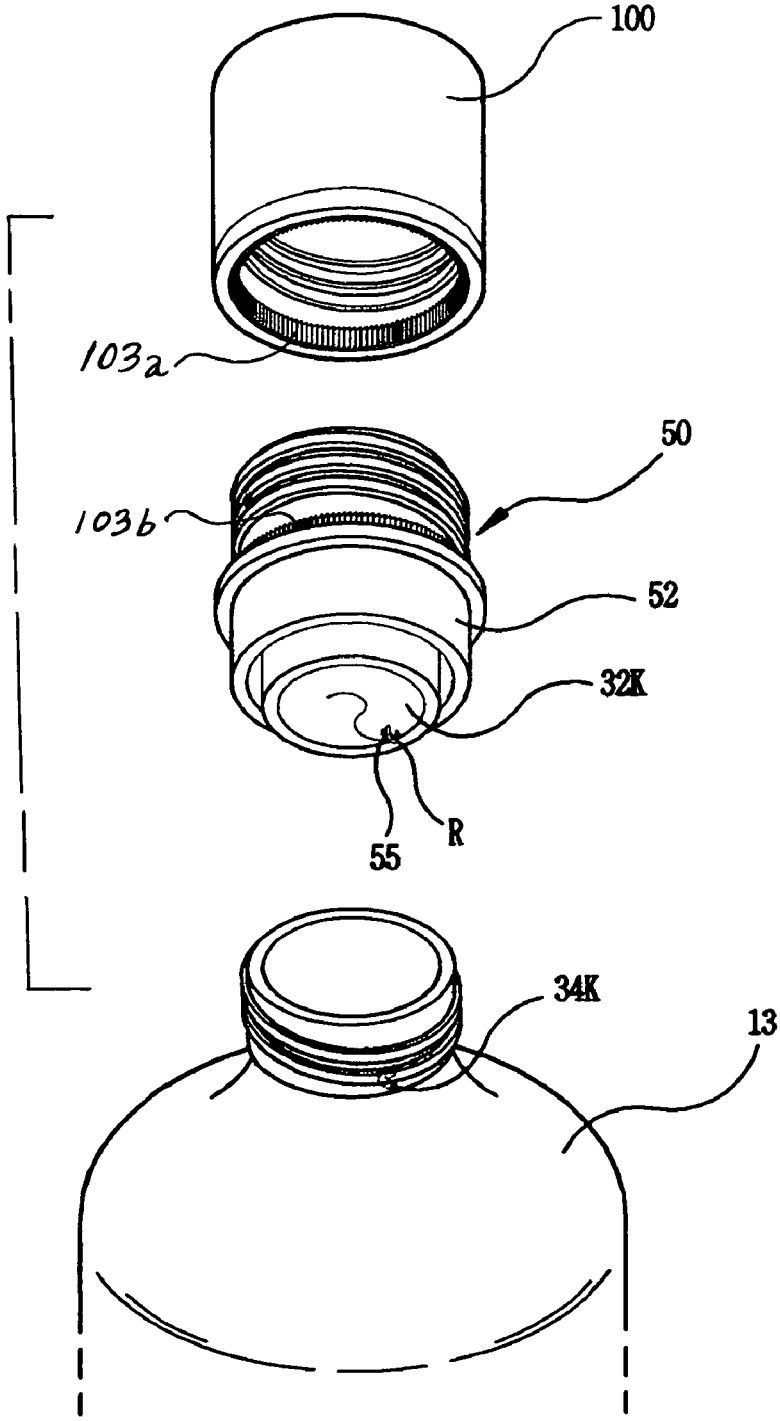
FIG. 7 is an exploded perspective view showing a construction of a cap device, according to a fourth embodiment of the present invention.
Figure 8:
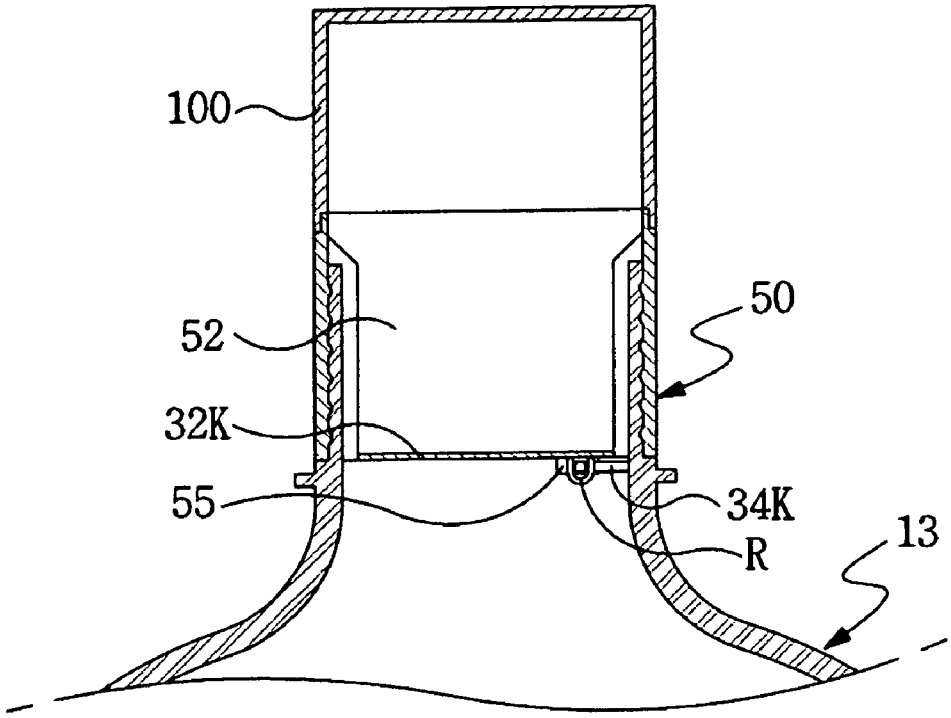
FIG. 8 is a sectional view of the cap device of FIG. 7 when the assembled cap device is tightened to a mouth of a bottle.

FIGS. 7 and 8 are views of a cap device for bottles according to a fourth embodiment of the present invention. As shown in the drawings, the general shape of the cap device according to the fourth embodiment remains the same as that described for the first embodiment, but the valve means is altered as follows. That is, the valve means according to the fourth embodiment comprises a breakable sheet 32K provided at the lower end of the funnel part 52 of the cap body 50 to close the lower end of the funnel part 52. The breakable sheet 32K has a structure to be easily broken to open the lower end of the funnel part 52 when the sheet 32K is thrust in a horizontal direction.

A breaking ring "R" is provided at a predetermined position on an outside area of a lower surface of the breakable sheet 32K. The breaking ring "R" has a structure to be thrust circumferentially on the breakable sheet 32K. A protrusion 55 is provided on the breakable sheet 32K at a position around the ring "R" to support the ring "R". The ring "R" is thus always kept upright even when it is thrust horizontally to break the breakable sheet 32K.

In the cap device according to the fourth embodiment, a thrusting rod 34K is projected from the inner surface of the neck of the bottle 13 at a position corresponding to the breaking ring "R" when the breaking ring "R" is rotated to move up along with the cap body 50, thus coming into contact with the breaking ring "R" to thrust the ring "R" in the horizontal direction. The thrusting rod 34K is formed through a double injection molding process.

In addition, the breakable sheet 32K provided at the lower end of the funnel part 52 has a breaking line comprising a sine-curved line part and an edge line part, and along which the sheet 32K is broken to form a large opening at the lower end of the funnel part 52 when the breakable sheet 32K is thrust to be broken.

When the cap body 50 of the cap device having the above-described construction is rotated to move up relative to the externally threaded mouth of the bottle 13, the breaking ring "R" of the valve means is stopped and thrust by the thrusting rod 34K, so that the breakable sheet 32K is broken to open the lower end of the funnel part 52.

Therefore, the cavity defined by the cap body 50 and the cap cover 100 of the cap device communicates with the interior of the bottle 13. The additive is thus discharged from the cavity defined by the cap body 50 and the cap cover 100 into the bottle 13 to be mixed with a material contained in the bottle 13 to produce a mixture.

In each of the cap devices of FIGS. 1 through 8, a vacuum pressure may act on the surface of the additive contained in the cavity of the cap device, when the cap cover 100 is completely closed. In such a case, the additive cannot smoothly flow from the cavity of the cap device into the bottle 13, even when the cavity communicates with the interior of the bottle 13 by an operation of the valve means. In order to allow the additive to smoothly flow from the cavity into the bottle 13 in response to the communication of the cavity with the interior of the bottle 13, a small vent hole provided with a valve cock "C" to open or close the vent hole is formed at a top surface of the cap cover 100. When the valve cock "C" opens the vent hole, atmospheric air is introduced into the cavity of the cap device through the vent hole, thereby preventing any vacuum pressure from acting on the surface of the additive in the cavity. The additive thus smoothly flows from the cavity of the cap device into the bottle 13, so that the additive is easily added to the material in the bottle 13 to produce a desired mixture.

Figure 9:
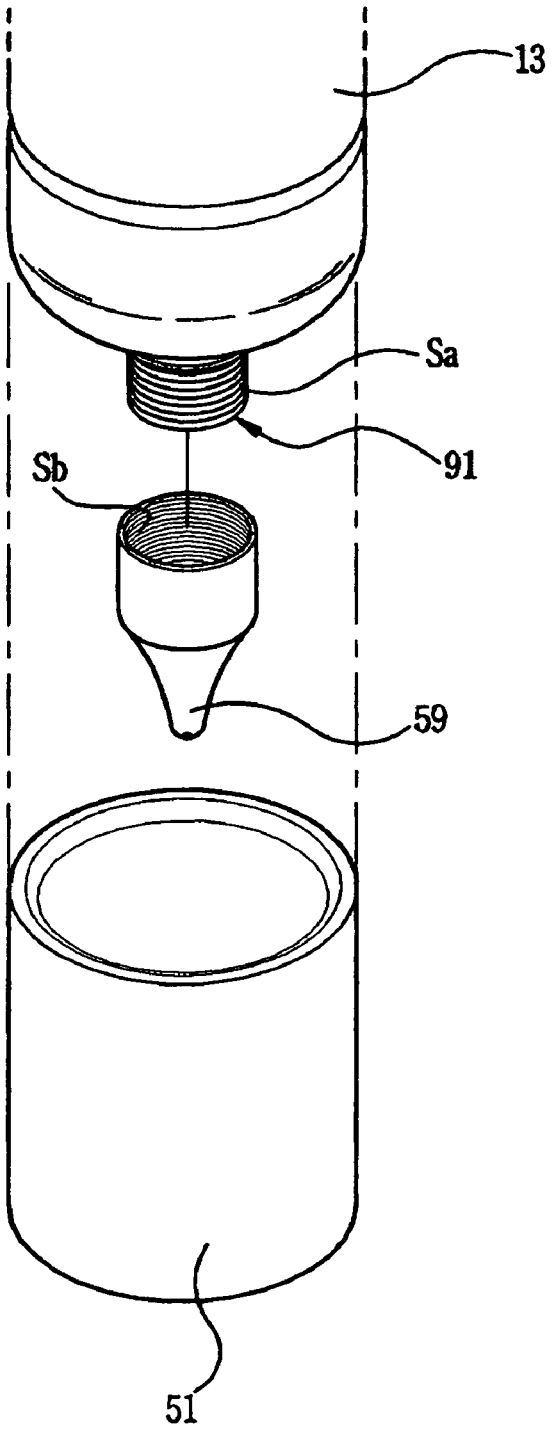
FIG. 9 is an exploded perspective view showing a bottle according to a further embodiment of the present invention, which is used with one of the cap devices of the present invention, with both a mixture-dispensing piece and a cup member provided at a spouted bottom of the bottle.
Figure 10:
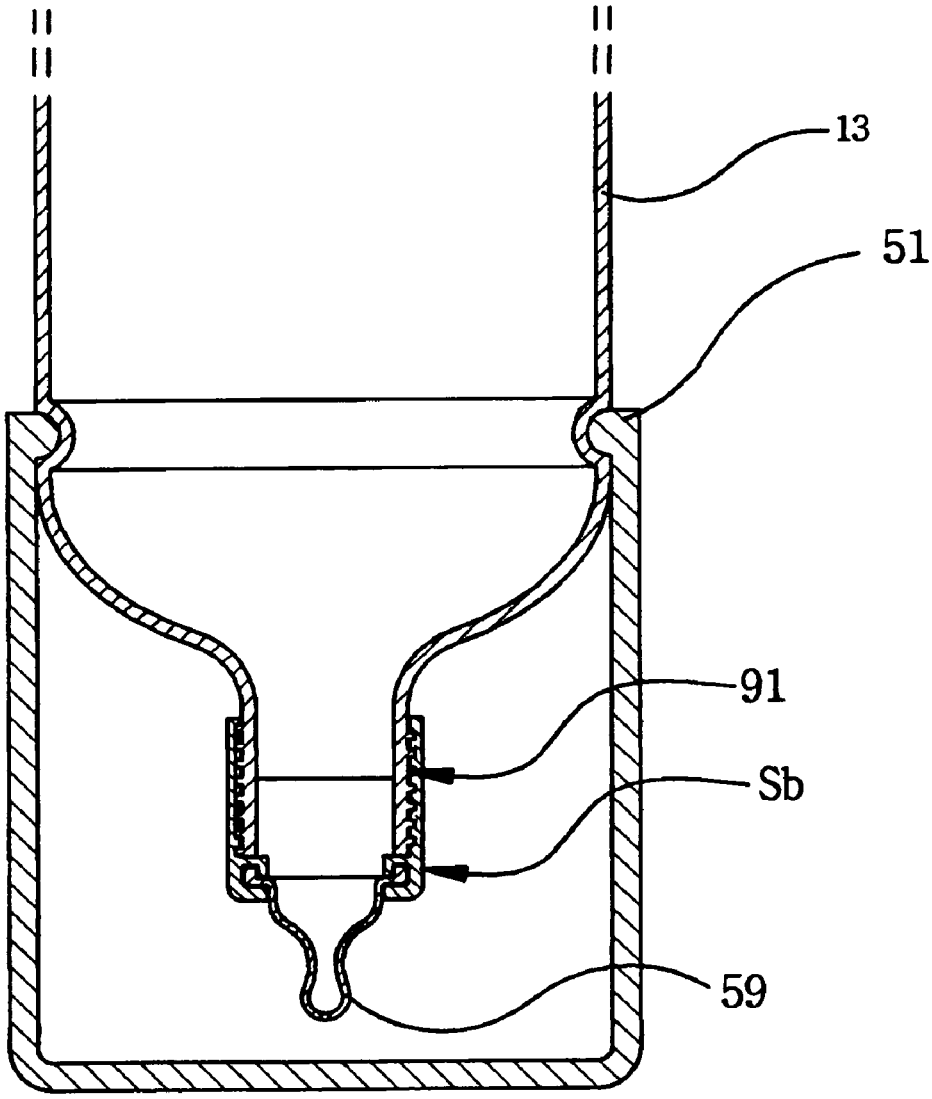
FIG. 10 is a sectional view of the bottle of FIG. 9, when the mixture-dispensing piece and the cup member are mounted to the spouted bottom of the bottle.
Figure 11:
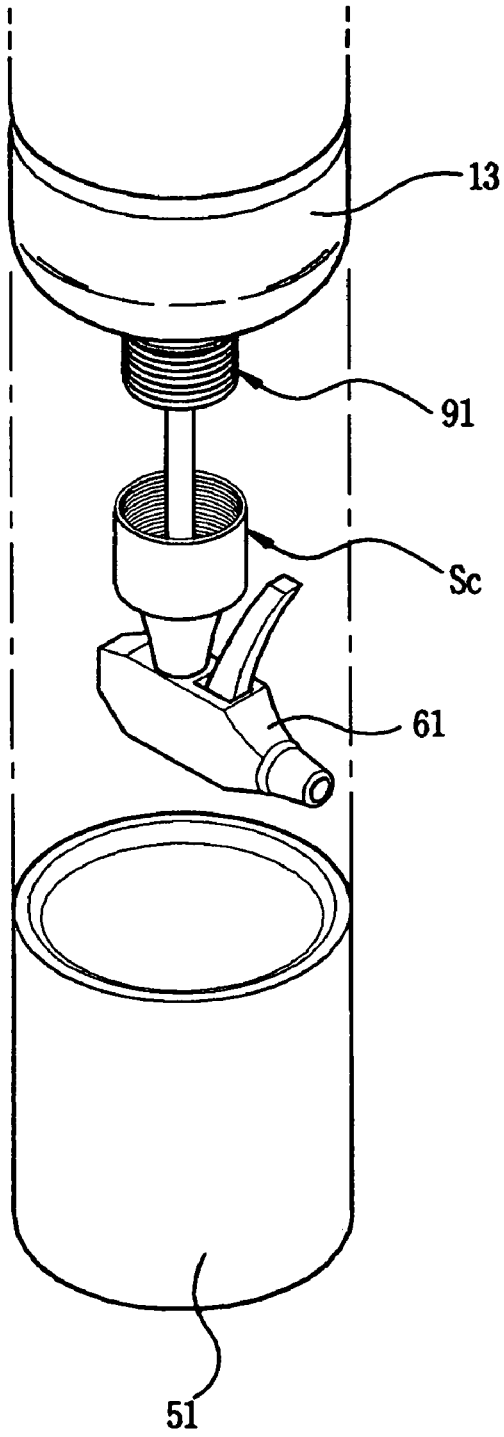
FIG. 11 is an exploded perspective view showing a bottle according to yet another embodiment of the present invention, which is used with one of the cap devices of the present invention, with both a mixture spray unit and a cup member provided at a bottom of the bottle.

FIGS. 9 through 11 are views of bottles according to further embodiments of the present invention, which are used with the cap devices of the present invention. As shown in the drawings, a spout 91 having external threads "Sa" may be formed at a bottom of the bottle 13. In such a case, a mixture dispensing means removably engages with the external threads "Sa" of the spout 91. A cup member 51 is removably fitted over a lower portion of a sidewall of the bottle 13 to cover the mixture dispensing means.

In the embodiment of FIGS. 9 and 10, the mixture dispensing means comprises a mixture-dispensing piece 59 having internal threads "Sb" to engage with the external threads "Sa" of the spout 91. In the present invention, the mixture-dispensing piece 59 may be selected from rubber nipples for nursing, and ink dispensers.

In the embodiment of FIG. 11, the mixture dispensing means comprises a mixture spray unit 61 having internal threads "Sc" to engage with the external threads "Sa" of the spout 91 of the bottle 13.

In the above-described embodiments of the present invention, the cap body 50 and the cap cover 100 of the cap device is preferably assembled into a single body by use of a threaded structure and a toothed structure, as shown in FIG. 7.

That is, after the cap cover 100 is completely assembled with the cap body 50 into the single body by use of the threaded structure and the toothed structure, the cap cover 100 is not likely to easily rotate relative to the cap body 50. The cap cover 100 is thus prevented from an undesired removal from the cap body 50.

As described above, the present invention provides a cap device for bottles, which is capable of mixing an additive contained therein with a bottled material to prepare a mixture in accordance with a simple rotating action of the cap device relative to a bottle, performed by a user, thereby allowing the user to easily prepare the mixture just before taking or using the mixture. The cap device of the present invention allows the additive and the bottled material to be maintained in pure states without being mixed together before a user adds the additive to the bottled material by rotating the cap device relative to a mouth of the bottle. The cap device is thus free from physical or chemical problems of degradation in the effects of ingredients, change in colors, and a generation of floating matters and deposit experienced in conventional bottled mixtures marketed in a bottled state.

In addition, the cap device of the present invention allows the additive and the bottled material to be stored in separate states, and allows the user to mix a precise amount of the additive with the bottled material to prepare the mixture. Thus, the cap device does not force the user to separately purchase and handle an additive container and the bottle, and is convenient to the user. The cap device also prevents undesired leakage of the additive therefrom, thus preventing the additive from making the user's body or garments dirty. The cap device is also free from excessive consumption of natural resources due to the separate production of the containers for additives and the capped bottles. Since the cap device allows the user to mix the precise amount of the additive with the bottled material to prepare the mixture, it is possible to prevent change in taste and quality of the mixture in the case of preparing a mixed beverage through the mixing, and to prevent incomplete dissolution of effective ingredients of the additive in the bottled material or a failure of accomplishment of desired medical or chemical effects of the mixture in the case of preparing a mixed medicine or a mixed chemical through the mixing.

In addition, the parts of the cap body to contain the additive therein may be changed with new parts having a variety of capacities and shapes as desired without affecting the functioning of the invention, so that the cap body accomplishes the recent trend of compatibility.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cap device for bottles, comprising:

a cap body tightened to an externally threaded mouth of a bottle, with a funnel part integrally formed in the cap body to discharge an additive from the cap body into the bottle through a lower end thereof;

a cap cover assembled with the cap body to cover an open upper end of the cap body while defining a cavity inside both the cap body and the cap cover to contain the additive in the cavity;

valve means for opening or closing the lower end of the funnel part of the cap body in accordance with a rotating action of the cap body relative to the externally threaded mouth of the bottle;

wherein the valve means comprises:

an arc-shaped projection externally formed on a sidewall of the lower end of the funnel part of the cap body at a predetermined portion such that the arc-shaped projection has a predetermined length and a radius of curvature larger than a radius of rotation of the cap body, with the lower end of the funnel part being closed, and the arc-shaped projection being open;

a breakable sheet attached to the arc-shaped projection to close the open projection; and a cutting blade projected from an inner surface of a neck of the bottle at a position corresponding to the breakable sheet to break the breakable sheet in accordance with the rotating action of the cap body relative to the externally threaded mouth of the bottle.

* * * * *